United States Patent [19]

Bennett

[11] 4,056,206

[45] Nov. 1, 1977

[54] APPARATUS FOR UNLOADING ROD-LIKE ARTICLES FROM CONTAINERS

[75] Inventor: George Robert Bennett, London, England

[73] Assignee: Molins Limited, United Kingdom

[21] Appl. No.: 681,191

[22] Filed: Apr. 28, 1976

[30] Foreign Application Priority Data

May 2, 1975 United Kingdom ..... 18395/75

[51] Int. Cl.[2] ..... B65G 65/04

[52] U.S. Cl. ..... 214/302; 214/313

[58] Field of Search ..... 214/300, 301, 302, 307, 214/312, 313, 314, 315, 311, 1 Q

[56] References Cited

U.S. PATENT DOCUMENTS

| | | | |
|---|---|---|---|
| 1,763,499 | 6/1930 | Bolger | 214/302 |
| 3,486,647 | 12/1969 | Seragnoli | 214/302 |
| 3,655,080 | 4/1972 | Gianese | 214/302 |
| 3,703,242 | 11/1972 | Marradi | 214/302 |

*Primary Examiner*—Lawrence J. Oresky

*Attorney, Agent, or Firm*—Craig & Antonelli

[57] ABSTRACT

A tray unloader for rod-like articles such as cigarettes or cigarette filter rods has a rotatable frame haing a pair of tray carriers arranged back to back and in 180° rotational symmetry relative to a cental axis of the frame. The frame is disposed adjacent a hopper so that a tray in one carrier can unload directly into the hopper with a minimum of clearance, while the other carrier releases an empty tray and receives a full one. The frame is rotated through 180° for a tray change and in order to clear the hopper during rotation the axis of rotation is lifted.

16 Claims, 4 Drawing Figures

APPARATUS FOR UNLOADING ROD-LIKE ARTICLES FROM CONTAINERS

This invention relates to apparatus for unloading rod-like articles from containers. In particular the invention is concerned with apparatus for unloading cigarettes or filter rods from trays, for example in order to feed cigarettes into a cigarette packing machine or to supply filter rods to the magazine of a pneumatic distributing device.

In the cigarette industry it has become common to transport and/or temporarily store cigarettes or other rod-like articles in trays, which usually have a depth about the same as the length of the articles and store the articles parallel to the depth dimension. The conventional tray is open on its front face and on its upper side, as referred to the normal disposition of the tray in handling apparatus, i.e. with the rod-like articles substantially horizontal.

In typical tray unloading apparatus, for example for delivering cigarettes into the hopper of a cigarette packing machine, trays are successively inverted over the hopper to allow the cigarettes to fall from the trays into the hopper. A conventional tray may contain some 4000 cigarettes but with modern packing machines these cigarettes can be processed very quickly, so that it is important to quickly replace a tray once it has discharged its contents into the hopper. In this respect it may be noted that the cigarette level in the hopper will continue to fall during replacement of an empty tray with a full tray and, if the replacement is not carried out with sufficient speed, the cigarettes from the new tray will have to fall a long distance before reaching the level of cigarettes already in the hopper. This could result in the cigarettes not remaining parallel and, if cigarettes become misaligned in the hopper, the packing machine could be prevented from operating properly. Consequently, tray unloaders associated with modern cigarette packing machines, and more generally tray unloaders associated with any high speed apparatus for processing rod-like articles, should be capable of replacing feeding trays quickly.

It has already been proposed to reduce the tray replacement time in tray unloaders by providing a rotatable frame supporting carriers for a pair of symmetrically disposed trays, so that full trays may be successively supplied for discharge into a hopper or the like by rotation of the frame. In British Patent Specification No. 1,191,342, for example, the frame has carriers which are spaced by arms on opposite sides of its center of rotation so that the carriers rotate around the hopper. A more compact arrangement can be achieved by arranging the carriers closer together, e.g. back to back, with the center of rotation between them and above the hopper. One problem which may be experienced with any apparatus of this type having a rotatable frame is that on the one hand the emptying tray and hopper should be close together to minimise the distance through which the rod-like articles have to fall, while on the other hand sufficient clearance must be provided for rotation of the carrier frame during tray changing.

According to the present invention apparatus for unloading rod-like articles from a tray comprises a rotatable frame member having at least two tray carriers, the frame member being rotatable between a first position in which a full tray may be received by a carrier and a second position in which said full tray in said carrier is positioned to discharge its contents into a hopper or the like, including means for lifting an axis around which the frame member is rotatable. The axis moving means may simply comprise guide means which constrains the frame member to a particular movement when it is rotated by external means, e.g. manually.

The arrangement may be such that the frame member is rotatable about a central axis and the lifting means is effective to lift this axis prior to the basic rotational motion and to lower it afterwards. In this way the tray carriers and trays can be positioned adjacent the hopper for unloading but avoid it during rotation for a tray change. In one arrangement the initial and final motion of the frame member in each cycle (i.e. replacement of an empty tray with a full one) is a bodily arcuate movement of the frame member about a pivot axis offset from the central axis of rotation for the frame member, and the intermediate motion is rotation of the frame member about the central axis.

In another arrangement there may be no identifiable single axis of rotation for the frame member as such but the effective rotational axis may move relative to the frame member itself. For example the rotational motion of the frame member may be constrained by cam means which causes the position of the axis of rotation to change between first and second spaced positions as the member rotates.

A preferred construction of the frame member has two parallel carriers on opposite sides of a central axis, the carriers being adapted to hold trays in positions which have 180° rotational symmetry relative to the axis. (The central axis need not be an axis about which the frame member is actually rotated). The frame member has a first rotational position in which one of the carriers is placed to receive a full tray and the other carrier is located over a hopper or the like (so that a tray in said other carrier can discharge its contents into the hopper), and a second rotational position, which could be achieved by 180° rotation from the first position, in which the one carrier is located over the hopper and the other carrier is in the tray receiving position. Empty trays may be removed from the carriers at the tray receiving position.

Trays may be supplied to and removed from the carriers of the frame member by hand. The rotation of the frame member may also be hand-operated, the movement of the rotational axis being caused by cam or other guide means as the frame member is rotated. Alternatively, trays can be supplied and removed by conveyor means which may operate in conjunction with a drive mechanism for rotating the frame member. The drive mechanism for a tray change may be initiated by an operator or, for example, by a photocell which registers when one tray has discharged its full contents. The rotational motion of the frame member and the movement of the axis of rotation may be provided by a single mechanism.

The invention will now be further described, by way of example only, with reference to the accompanying diagrammatic drawings in which.

Figure 1:
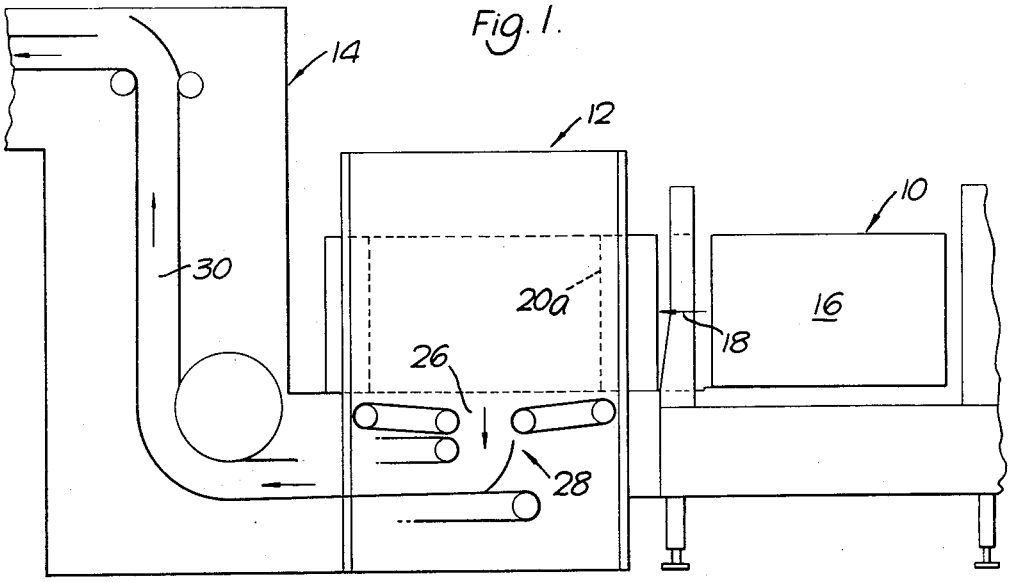
FIG. 1 is an elevation of a machine embodying tray unloading apparatus.

The machine shown in FIG. 1 comprises tray conveying means 10, tray unloading apparatus 12, and stack conveying apparatus 14. A succession of conventional trays 16, containing filter rods for example, are delivered by conveyor means 10 in a direction parallel to the rods in the trays. Each tray is arranged with its open side uppermost. At a predetermined position alongside the unloading apparatus 12 full trays 16 are successively pushed sideways from the conveyor means 10, as indicated by arrow 18, and into a tray carrier 20*a* mounted on a rotatable frame member 22 (see also FIG. 2). The frame member 22 is rotatable about an axis 24 and carries another tray carrier 20*b*. The tray carriers 20*a* and 20*b* are in 180° rotational symmetry relative to axis 24.

Each tray carrier 20 is adapted to receive a tray 16 and hold it. In the position shown in the drawings the upper end of the tray carrier 20*a* is open: this corresponds to the open upper side of the tray 16 inserted into the tray carrier. Each tray carrier has means for retaining the tray in the carrier and means for retaining the rods in the tray at said upper end.

Figure 2:
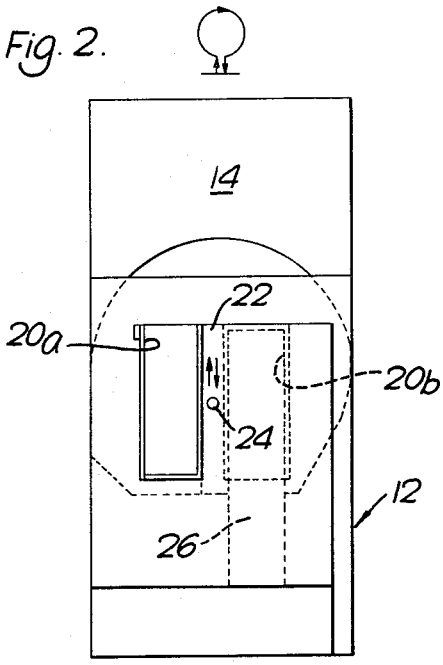
FIG. 2 is a side view of the tray unloading apparatus of FIG. 1.

By referring to FIG. 2 it can be seen that the tray carrier 20*b* is directly over a magazine 26 which receives rods unloaded from the tray within the carrier. The magazine 26 and associated equipment 28 for delivering a stack of rods from the tray unloading apparatus may be essentially as disclosed in U.S. Pat. No. 3,985,252. As shown in FIG. 1, the stack of rods delivered from the unloader 12 to the conveying apparatus 14 may be elevated as at 30 for delivery to further apparatus, e.g. a machine for assembling filter cigarettes. The equipment 28 may be replaced by conventional apparatus which does not deliver the unloaded rods as a stack (see e.g. U.S. Pat. No. 3,503,487).

The arrangement whereby trays are unloaded in the unloader 12 will now be described in more detail. Consider the position in FIG. 2 with a tray in an inverted position in carrier 20*b* delivering rods to the magazine 26. A full tray is supplied to the carrier 20*a* from the conveyor means 10. When the contents of the tray in carrier 20*b* have been fully discharged the mechanism for making a tray change by rotation of the frame member 22 is initiated. This may be done automatically by means of a photocell at the top of the magazine 26 which detects a gap in the flow of rods.

In order to change trays the frame member 22 is required to be rotated through 180°. However, simple rotation about axis 24 is not possible since the carrier 20*b* would foul the top of magazine 26. This is avoided by lifting the frame member 22 and its axis 24, then rotating through 180° about axis 24, and finally lowering the frame member and its axis. The movement is indicated by the arrows above the apparatus in FIG. 2. Mechanism for producing this movement is described later with reference to FIG. 3.

During the overturning of the full tray in carrier 20*a* retaining means carried by frame member 22 is in position to prevent rods from falling from the open upper side of the tray. Similar retaining means is associated with carrier 20*b*. The retaining means may comprise a movable plate, or a pair of pivoted slats which engage the ends of the rods. After overturning, as a carrier is lowered onto the magazine, cam means may operate the retaining means to allow the rods to fall into the magazine.

When the frame member 22 has been rotated and the carrier 20*a* is in position over the magazine 26, the empty tray is withdrawn from the carrier 20*b* by a slide mechanism and deposited on the conveyor means 10. The conveyor means 10 is then indexed to bring a full tray into alignment with carrier 20*b* and the slide mechanism operated to load the full tray into the carrier ready for the next tray change. Thus the only delay in a tray change is the movement of the frame member 22, which can be effected at speed.

Instead of using conveyor means 10 the trays may be loaded or unloaded by hand, and may be inserted and removed from the front or from below or above instead of from the side. When the movement of the frame member to cause a tray change is initiated by an operator it is important to be able to observe the level of rods in the unloading tray. For this purpose the trays may be inserted in the carriers 20 with their open front faces outermost and the adjacent outer face of the carrier may be of transparent plastics material.

Figure 3:
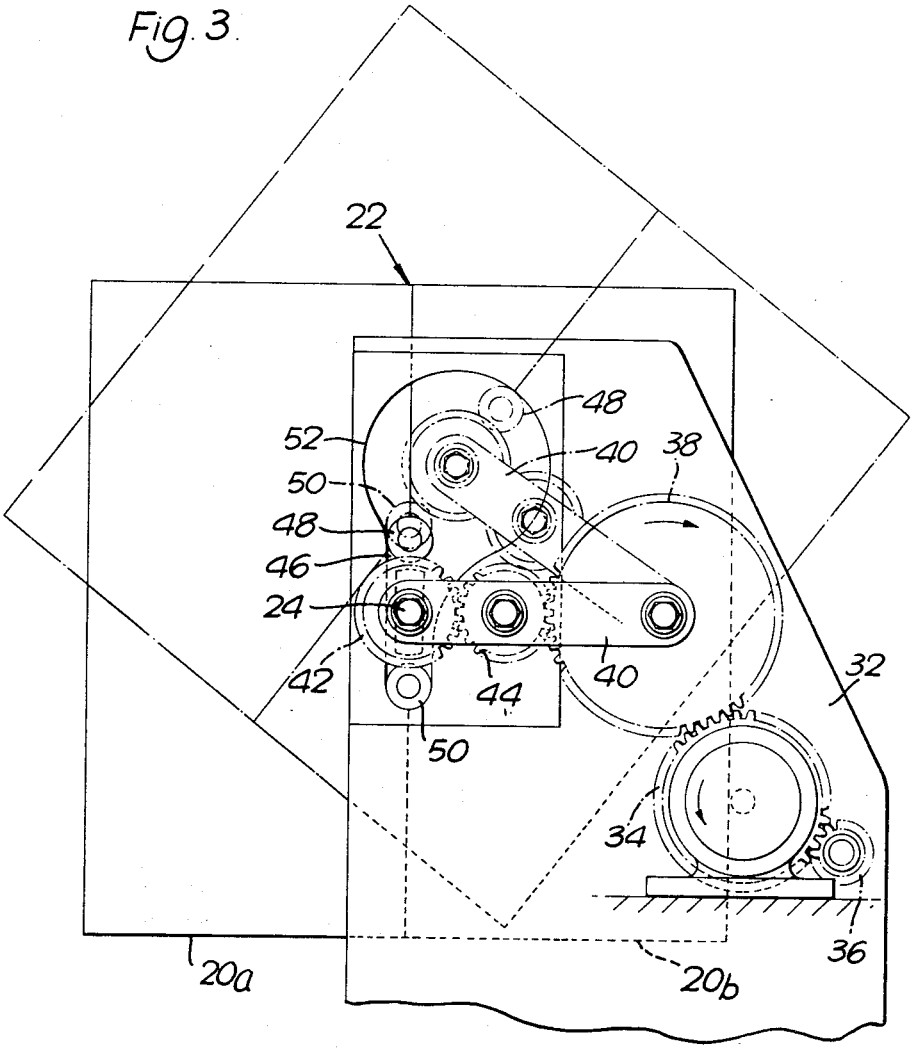
FIG. 3 shows one arrangement for operating a tray unloading apparatus.

The drive mechanism for producing the movement of the frame member 22 during a tray change is shown in FIG. 3, which is a side view as in FIG. 2. The carriers 20*a* and 20*b*, are substantially as in FIG. 2 but for the sake of clarity have been indicated in outline only. The frame member 22 is supported by side plates 32 fixed to the structure of the apparatus 12. Fixed to the side plate 32 shown in FIG. 3 is a motor having an output gear 34. The output gear 34 drives a mechanism attached to its own side plate 32 and also a cross drive shaft 36 which is engaged with an effectively similar mechanism mounted on the other side plate. The apparatus will hereinafter be described with reference to the mechanism on the side plate 32 shown in the drawing, it being understood that a similar mechanism operates in tandem on the other side plate, driven by the drive shaft 36.

The output gear 34 is engaged with a gear wheel 38 rotatably mounted on the side plate 32. A link 40 is pivotally mounted on the axis of gear wheel 38 and rotatably carries at its end another gear wheel 42. Also rotatably mounted on the link 40 is a further gear wheel 44 which is engaged with both the gear wheel 38 and the gear wheel 42. An arm 46 mounted at its center on the axis of gear wheel 42 for rotation therewith carries rollers 48, 50 at its ends, the rollers being constrained within a keyhole slot 52 formed in part of the side plate 32. The frame member 22 is connected to the arm 46 so that the axis is coincident with the axis of gear wheel 42.

The keyhole slot 52 comprises an upper part-circular portion and a lower straight-sided portion. The lower portion of the slot could have curved sides. In the position of the frame member indicated by full lines in FIG. 3 the arm 46 is at its lowermost position, with one of the rollers (50) at the bottom of the slot 52: this corresponds to the position of the frame member 22 when a tray in one carrier (20*b*) is unloading over the magazine.

In order to change trays the motor is operated causing gear wheel 38 to move clockwise (as viewed in FIG. 3). This tends to turn gear wheel 42 and arm 46 clockwise about axis 24 via idler gear 44. However, the position of the arm 46 and roller 50 in the slot 52 prevents any substantial rotation of gear wheel 42 and effectively locks the gear train on link 40. This results in gear wheel 38 causing the link 40 to pivot about its axis into the position shown in chain-dotted lines in FIG. 3. Once the arm 46, and in particular roller 50, is clear of the straight-sided portion of slot 52 the arm 46 can rotate in the part-circular portion of the slot, which has a diameter corresponding to the rolling distance between rollers 48 and 50.

The arm 46 rotates in the part-circular portion of slot 52 until the upper roller 48 has rotated far enough to leave said portion and begin to fall, following the shape of the slot, into the lower part of the slot. Thus the arm 46 and link 40 fall back down, pivoting about the axis of gear wheel 38 until the roller 48 is at the bottom of the slot 52. At this stage the motor is stopped. The frame member has been rotated through 180° and is in position to discharge the contents of a full tray into the magazine. In FIG. 3, in the position shown in full lines, the tray carrier **20*b* would hold the inverted tray emptying into the magazine, while the tray carrier 20*a*** would be receiving a full tray ready for the next tray change.

It will be noted that the angle of rotation of the frame member 22 while the axis 24 is at its highest point (i.e. at the center of the part-circular portion of slot 52) is considerably less than 180°. The remainder of the rotational movement occurs during rise and descent of the frame member. This arrangement still ensures sufficient clearance between the rotating frame member and the top of the magazine.

In order to reduce the shock caused by the fall of the frame member as the arm 46 drops back into the lower part of the slot 52 it may be advisable to reverse the motor drive at an appropriate point. Thus the gear wheel 38 may be rotated clockwise through about 90° and then reversed through about 5° or 10° just prior to the drive being stopped. A similar effect can be achieved by use of a lost motion linkage. As an alternative to a gear train a chain and sprocket drive could be used on the link 40.

Separate drive means can be used to lift and rotate the frame member. For example pneumatic or hydraulic cylinders, or a rack and pinion, could be used to lift and lower the frame member, whilst a separate motor could provide the rotational motion.

Figure 4:
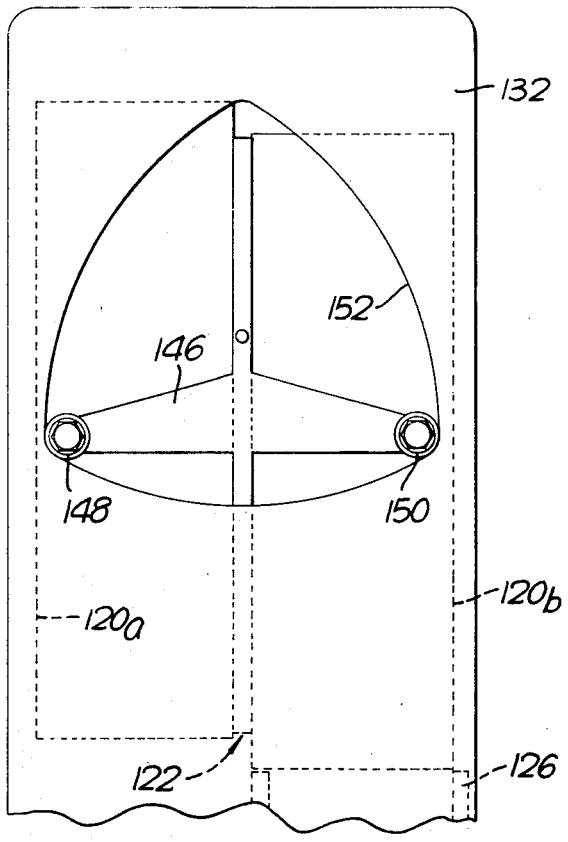
FIG. 4 shows an alternative arrangement for operating a tray unloading apparatus.

A further arrangement for causing the required movement of the frame member 22 is shown in FIG. 4. This arrangement is intended mainly for manual or semiautomatic operation in which trays are loaded and unloaded from the front. A frame member 122 comprising tray carriers **120*a* and 120*b* is shown in a position wherein a tray in carrier 120*b* can unload into a hopper 126. Attached to the frame member 122 is an arm 146 supported on side plate 132 by means of rollers 148, 150 which engage a track formed by a slot 152 in the side plate. An identical arm and side plate are arranged on the other side of the frame member 122.**

The slot 152 comprises three arcs of equal length and radius. The radius corresponds to the distance from the axis of one roller on the arm 146 to the far side of the other roller. The arm 146 is arranged in the slot 152 so that with one roller in an apex the other roller can roll on the opposite arc.

In order to change trays from the position shown in FIG. 4 the frame member 122 may be rotated clockwise about the axis of roller 150 so that the roller 148 moves up the opposite arcuate surface of the slot 152. When the roller 148 reaches the upper apex this becomes the axis of rotation and the roller 150 traverses the lower arc. Finally the frame member rotates about the axis of roller 150, now in the lower left-hand apex, while the roller 148 moves down the opposite surface. The frame member has now been moved through 180° to change the positions of carriers **120*a* and 120*b*.** The initial and final movements of the frame member are such that the carriers are lifted away and lowered onto the hopper respectively. The rotational movement of the frame member may be carried out manually or by a mechanical drive.

I claim:

1. Apparatus for unloading rod-like articles from a tray, comprising a rotatable frame member having at least two tray carriers, the frame member being rotatable about a transverse axis through said frame member to effect interchange of said tray carriers between a first position in which a full tray may be received by a carrier and a second position in which said full tray in said carrier is positioned to discharge its contents into a hopper or the like, and means for lifting said axis around which the frame member is rotatable during movement of the frame member between said first and second positions including guide means for constraining both lifting and rotation of the frame member as it is moved between said positions, said guide means preventing rotation about said axis until said lifting has started.

2. Apparatus as claimed in claim 1 wherein said frame member is rotatably mounted on support means about said axis, said support means being constrained by said guide means to lift said axis during initial movement from said first position and to lower said axis during final movement to said second position, the intermediate movement between said positions being by rotation about said axis.

3. Apparatus as claimed in claim 2 wherein said support means is mounted so that its movement is arcuate about a fixed pivot.

4. Apparatus as claimed in claim 2 wherein said support means carries drive means for rotating said frame member about said axis.

5. Apparatus as claimed in claim 4 wherein said drive means also operates to produce said initial movement from said first position.

6. Apparatus as claimed in claim 1 wherein the frame member is rotatable about spaced first and second axes, the guide means being arranged such that initial movement from said first position comprises rotational movement about said first axis which lifts said second axis, subsequent rotational movement about said second axis shifts said first axis, and final rotational movement about said first axis lowers said second axis.

7. Apparatus as claimed in claim 1 wherein the frame member includes two parallel carriers, the carriers being adapted to hold trays in positions which have 180° rotational symmetry relative to an axis between said carriers.

8. Apparatus as claimed in claim 7 wherein one carrier is in said first position when the other carrier is in said second position and vice versa.

9. Apparatus as claimed in claim 1 wherein said guide means comprises at least one follower member and an endless track, and means maintaining the follower member on the track.

10. Apparatus as claimed in claim 1 including common drive means for lifting and rotating said frame member.

11. Apparatus for unloading rod-like articles from a tray, comprising a frame member having a pair of tray carriers mounted thereon, support means for mounting said frame member for rotation about an axis transverse thereto and extending between said tray carriers and drive means for effecting rotation of said frame member between a first position in which a full tray may be received by a carrier and a second position in which said full tray in said carrier is positioned to discharge its contents into a hopper or the like, said support means including guide means coupled to said axis for constraining movement of said axis to effect sequential lifting and then rotation and then lowering of said axis as said frame member is moved from said first position to said second position by said drive means.

12. Apparatus as claimed in claim 11 wherein said guide means comprises an endless track and a follower member mounted on said endless track and being connected to said axis of said frame member.

13. Apparatus as claimed in claim 12 wherein said carriers are mounted in parallel on said frame member and are adapted to hold trays in positions which have 180° rotational symmetry relative to said axis.

14. Apparatus as claimed in claim 12 wherein said support means further includes a pair of side support plates providing said endless track and being respectively positioned on opposite sides of said frame member for effecting support thereof in said first and second positions and the positions intermediate thereto.

15. Apparatus as claimed in claim 14 wherein said drive means comprises a first gear wheel mounted on one of said side support plates, means for driving said first gear wheel, a link pivotally mounted at one end thereof on the axis of said first gear wheel, a second gear wheel mounted on the axis of said frame member for rotation with said follower member, the other end of said link being mounted on the axis of said frame member so as to be pivotable with respect to said second gear wheel and said follower member, and an idler wheel mounted on said link in engagement with said first and second gear wheels.

16. Apparatus as claimed in claim 14 wherein said endless track comprises a keyhole slot formed in said side support plates and in which said follower member is guided.

* * * * *